US008431007B2

(12) United States Patent
Tarng et al.

(10) Patent No.: US 8,431,007 B2
(45) Date of Patent: Apr. 30, 2013

(54) ELECTRO-THINNING APPARATUS FOR REMOVING EXCESS METAL FROM SURFACE METAL LAYER OF SUBSTRATE AND REMOVING METHOD USING THE SAME

(75) Inventors: Shin-Luh Tarng, Austin, TX (US); Chao-Fu Weng, Tainan (TW)

(73) Assignee: Advanced Semiconductor Engineering Inc., Kaohsiung (TW)

( * ) Notice: Subject to any disclaimer, the term of this patent is extended or adjusted under 35 U.S.C. 154(b) by 811 days.

(21) Appl. No.: 12/625,996

(22) Filed: Nov. 25, 2009

(65) Prior Publication Data

US 2010/0224504 A1 Sep. 9, 2010

(30) Foreign Application Priority Data

Mar. 6, 2009 (TW) ..... 98107453 A

(51) Int. Cl.
*C25F 3/02* (2006.01)
*C25F 7/00* (2006.01)
*H05K 3/07* (2006.01)

(52) U.S. Cl.
USPC ..... 205/654; 205/666; 205/686; 204/199; 204/200; 204/216

(58) Field of Classification Search ..... 205/654, 205/666, 686
See application file for complete search history.

(56) References Cited

U.S. PATENT DOCUMENTS

| | | | | |
|---|---|---|---|---|
| 5,164,033 | A * | 11/1992 | Whitehead | 205/651 |
| 5,804,052 | A * | 9/1998 | Schneider | 205/96 |
| 6,322,684 | B1 * | 11/2001 | Hodko et al. | 205/125 |
| 7,648,616 | B1 * | 1/2010 | Boyd et al. | 204/252 |

FOREIGN PATENT DOCUMENTS

| | | |
|---|---|---|
| CN | 1174252 A | 2/1998 |
| CN | 101210344 A | 7/2008 |
| JP | 1034611 | 2/1989 |

* cited by examiner

*Primary Examiner* — Harry D Wilkins, III
*Assistant Examiner* — Bryan D. Ripa
(74) *Attorney, Agent, or Firm* — Muncy, Geissler, Olds & Lowe, PLLC

(57) ABSTRACT

An electro-thinning apparatus for removing excess metal from the surface metal layer of the substrate is provided. The apparatus includes an electrolysis bath, a transportation system, an anode roller, a cathode roller, and at least one shielding plate. The electrolysis bath contains an electrolysis liquid. The transportation system is disposed in the electrolysis bath for moving a substrate from an upstream end to a downstream end. The anode roller is disposed relative to the electrolysis bath and located upstream to the transportation system. The cathode roller is located above the transportation system and located downstream to the anode roller. The at least one shielding plate is located downstream to the cathode roller. During electrolysis, the anode roller contacts a surface metal layer of the substrate while the cathode roller is partly immersed in the electrolysis liquid and away from the surface metal layer of the substrate during electrolysis.

18 Claims, 4 Drawing Sheets

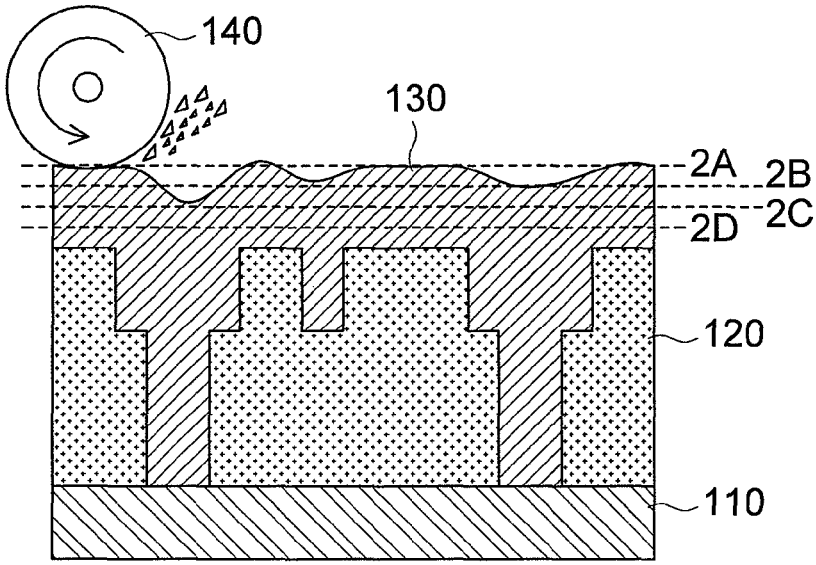
FIG. 1(PRIOR ART)
FIG. 2A (PRIOR ART)
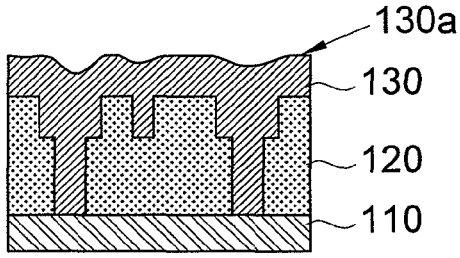
FIG. 2B (PRIOR ART)
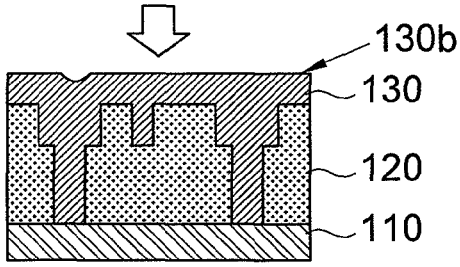
FIG. 2C (PRIOR ART)
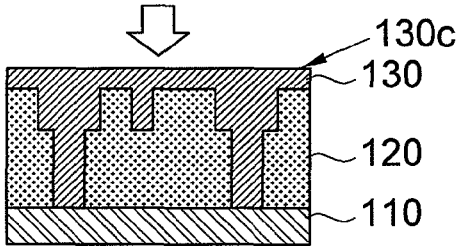
FIG. 2D (PRIOR ART)
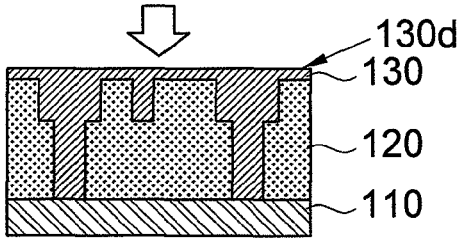

ELECTRO-THINNING APPARATUS FOR REMOVING EXCESS METAL FROM SURFACE METAL LAYER OF SUBSTRATE AND REMOVING METHOD USING THE SAME

This application claims the benefit of Taiwan application Serial No. 98107453, filed Mar. 6, 2009, the subject matter of which is incorporated herein by reference.

BACKGROUND OF THE INVENTION

1. Field of the Invention

The invention relates in general to an electro-thinning apparatus for removing excess metal from the surface metal layer of the substrate and the removing method using the same, and more particularly to an electro-thinning apparatus capable of continuously removing excess metal from the surface metal layer of the substrate without contacting the surface and a removing method using the same.

2. Description of the Related Art

As lightweight, thinness, compactness, and high efficiency have become universal requirements of consumer electronic and communication products, the chips used in the above products need to be excellent in electronic properties, versatile in functions and small in size. Along with the maturity in chip-size package (CSP) technology, system in package (SiP) has become the mainstream in package technology. System in package integrates chips of different functions, passive components and other modules together, so that the electronic products have versatile functions. System in package also includes different technologies such as 2-dimensional multi-chip module package and 3-dimensional stacked package which stacks chips of different functions for saving space. Under the trend of reducing the overall size, the pitch between integrated circuits becomes smaller and smaller, and it is more and more difficult to achieve high-efficiency wiring on the substrate. Thus, the design of embedding passive components or circuits into the substrate is provided, and the carrier possessing electrical property is called the integrated substrate or the functional substrate.

The step of thinning or planarizing the conductive material by removing excess conductive material is an indispensible step in the manufacturing process, no matter the electronic products adopt a conventional substrate (such as printed circuit board), or an embedded passive component and/or an embedded-trace substrate. The current methods of removing excess conductive material such as mechanical grinding, chemical solution erosion, chemical mechanical polishing (CMP), or contact electrolysis all have disadvantages.

A conventional manufacturing process using two planarizing methods is exemplified below. The mechanical grinding method is used for thinning excess conductive material first, and then a chemical solution is used for etching the excess metal so that the conductive material is planarized.

Referring to FIG. 1~FIG. 3B. FIG. 1 shows a thick metal layer being thinned according to a conventional method of mechanical grinding. FIG. 2A~FIG. 2D show the metal layer of FIG. 1 being thinned according to multiple steps of grinding. As indicated in FIG. 1 and FIG. 2A~FIG. 2D, the dielectric layer pattern 120 on the substrate 110 (such as a printed circuit board PCB) is covered by a thick metal layer 130, and a grinding wheel 140 rotates with respect to the surface of the metal layer 130 at a high speed to incur many flash grinding on the surface of the metal layer 130. The lines 2A~2D of FIG. 1 denote the positions of different grindings incurred on the surface of the metal layer 130 by the grinding wheel 140.

The surfaces of the metal layer after grinding are respectively illustrated by the surfaces 130*a*~130*d* of FIG. 2A~FIG. 2D. After mechanical grinding, the bumping surfaces as indicated in FIGS. 1, 2A and 2B are planarized as shown in FIG. 2C. To make the subsequent planarization process (such as chemical etching) easier, the surface 130*c* of the metal layer continues to be thinned and at last becomes the surface 130*d* as indicated in FIG. 2D. Then, the element of FIG. 2D, which has been through the mechanical grinding process, is immersed in a container containing an etching solution 150 as indicated in FIG. 3A, and the excess metal layer is etched by the etching solution 150. Finally, as indicated in FIG. 3B, the metal layer is planarized after chemical etching process, that is, the metal layer surface 130*d* is substantially aligned with the surface of the dielectric layer pattern 120.

However, there are grinding residues generated during the mechanical grinding process of removing excess conductive material. If the grinding force is not uniformly applied to the element due to the grinding residues, the element may be deformed, scratched or cracked. The method of chemical erosion can only planarize the surface of the element to a certain degree, and the etching stop point is hard to control. Also, it is difficult to precisely etch the selected region and switch the etching targets optionally.

The chemical mechanical polishing (CMP) method, which combines the method of mechanical grinding and the method of chemical erosion. A to-be-processed piece is pressed on an elastic pad (the grinding pad) which is rotating. By means of relative-movement polishing technology, an erosive solution is provided to the to-be-processed piece. While the to-be-processed piece is eroded, a polishing material with micro-wear particles whose diameter is less than 100 nanometers is provided on the targeted area for selectively grinding the to-be-processed piece. Thus, the method combining chemical erosion and mechanical grinding is so called chemical mechanical polishing (CMP). The CMP method inherits both disadvantages of the methods of mechanical grinding and chemical erosion, such as particles pollution, grinding residue, slurry residue, occurrences of scratch, crack, recess, erosion and void, and less reliability of manufacturing process, all have considerable effects on the yield rate of the devices.

SUMMARY OF THE INVENTION

The invention is directed to an electro-thinning apparatus for removing excess metal from the surface metal layer of the substrate and a method thereof for removing excess metal. The electro-thinning apparatus conducts electrolytic reaction is able to continuously remove excess metal without contacting the surface metal layer of the substrate; therefore, the problems of deforming the substrate or over-etching the metal can be avoided.

According to a first aspect of the present invention, an electro-thinning apparatus for removing excess metal from the surface metal layer of the substrate is provided. The apparatus includes an electrolysis bath, a transportation system, an anode roller, a cathode roller, and at least one shielding plate. The electrolysis bath contains an electrolysis liquid. The transportation system is disposed in the electrolysis bath for moving a substrate from an upstream end to a downstream end of the transportation system, wherein the substrate is immersed in the electrolysis liquid. The anode roller is disposed relative to the electrolysis bath and located upstream to the transportation system. The cathode roller is located downstream to the anode roller, wherein the cathode roller is partly immersed in the electrolysis liquid and away from the surface metal layer of the substrate during electrolysis. At least one shielding plate is located downstream to the cathode roller. During the operation of the electro-thinning apparatus for removing excess metal, the anode roller contacts a surface metal layer of the substrate while the cathode roller and is away from the surface metal layer of the substrate. When the substrate contacted by the anode roller is moved towards the downstream end of the transportation system, there is an electrical field generated between the surface metal layer of the substrate and the cathode roller except for the area of the substrate being shielded by the shielding plate.

According to a second aspect of the present invention, a method for removing excess metal from the surface metal layer of the substrate is provided. The method includes the following steps of:

Providing an electro-thinning apparatus, including:

an electrolysis bath containing an electrolysis liquid;

a transportation system disposed in the electrolysis bath and having an upstream end and a downstream end;

an anode roller located upstream to the transportation system;

a cathode roller located downstream to the anode roller, wherein the cathode roller is partly dipped into the electrolysis liquid; and at least one shielding plate located downstream to the cathode roller;

Disposing a substrate in the transportation system;

Moving the substrate from the upstream end to the downstream end of the transportation system wherein the surface metal layer of the substrate is immersed in the electrolysis liquid but away from the cathode roller; and Electrolyzing the excess metal by contacting the anode roller with the surface metal layer of the substrate such that an electrical field is generated between the cathode roller and the surface metal layer of the substrate except for the area of the substrate being shielded by the shielding plate.

The invention will become apparent from the following detailed description of the non-limiting embodiments. The following description is made with reference to the accompanying drawings.

BRIEF DESCRIPTION OF THE DRAWINGS

FIG. 1 (Prior Art) shows a thick metal layer being thinned according to a conventional method of mechanical grinding;

FIG. 2A~FIG. 2D (Prior Art) show the metal layer of FIG. 1 being thinned according to multiple steps of grinding;

DETAILED DESCRIPTION OF THE INVENTION

The invention provides an electro-thinning apparatus for removing excess metal from the surface metal layer of the substrate and a removing method using the same. The removing method mainly employs continuous electrolytic reaction without contacting the surface metal layer of the substrate, not only continuously removing excess metal but also avoiding the substrate being deformed due to the stress applied thereto. Also, during the electrolysis process, the etching stop point can be well controlled so that the metal will not be over-etched. Thus, after excess metal is removed from the substrate using the method of the invention, the substrate still remains good external appearance and excellent electrical property. The method of the present invention has no effects on the yield rate of the elements. Moreover, the continuously operating electro-thinning apparatus provided in the invention can be widely used in various types of substrates regardless what size or what thickness the substrate is. The electrolysis rate of the electro-thinning apparatus can also be adjusted according to the to-be-removed thickness of the metal so as to achieve maximum electrolysis efficiency, which is indeed very flexible.

A number of embodiments are disclosed below for elaborating the electro-thinning apparatus for removing excess metal from the surface metal layer of the substrate and the removing method using the same of the invention. However, the apparatus and the method disclosed in the following embodiments are for exemplification only, not for limiting the scope of protection of the invention. Moreover, only key elements relevant to the technology of the invention are illustrated, and secondary elements are omitted for highlighting the technical features of the invention. Besides, the invention is applicable to various types of substrate for removing various types of metals. For example, the invention is used for removing excess copper on the surface of an embedded-trace substrate.

First Embodiment

Figure 3A:
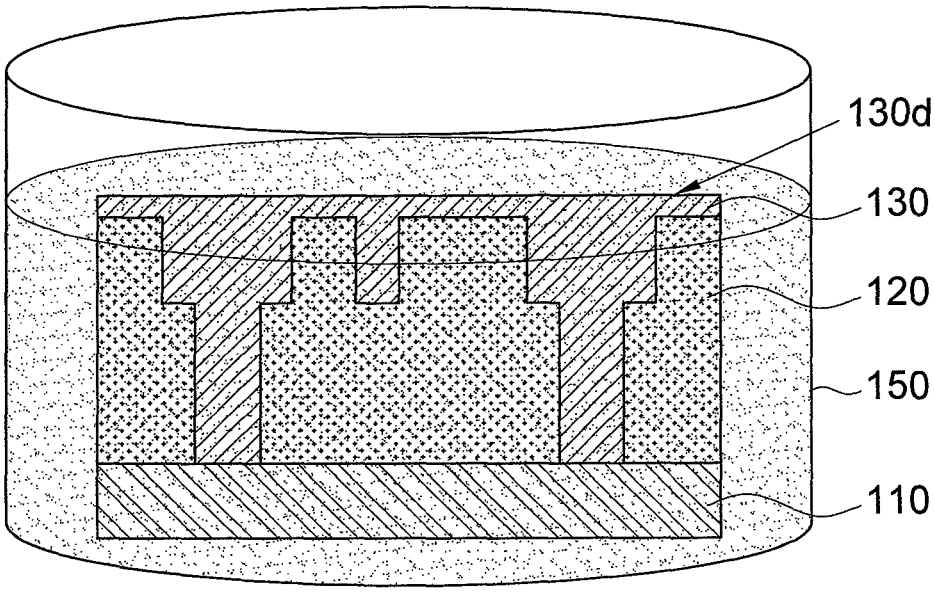
FIG. 3A(PRIOR ART)
FIG. 3A (Prior Art) shows excess metal being etched by using a chemical etching solution.
Figure 3B:
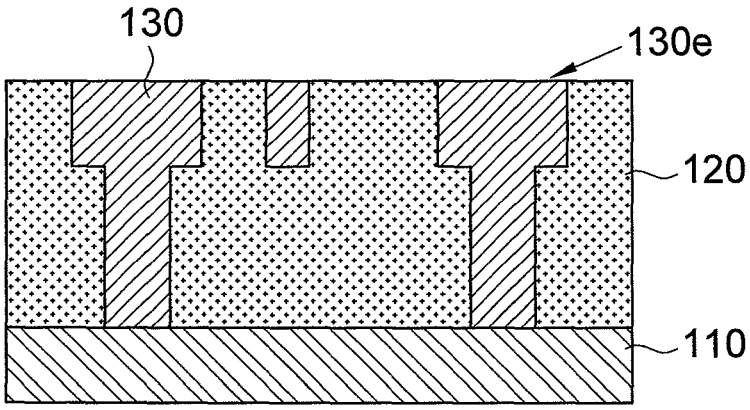
FIG. 3B(PRIOR ART)
FIG. 3B (Prior Art) shows the metal layer of FIG. 3A being flattened after chemical etching.
Figure 4:
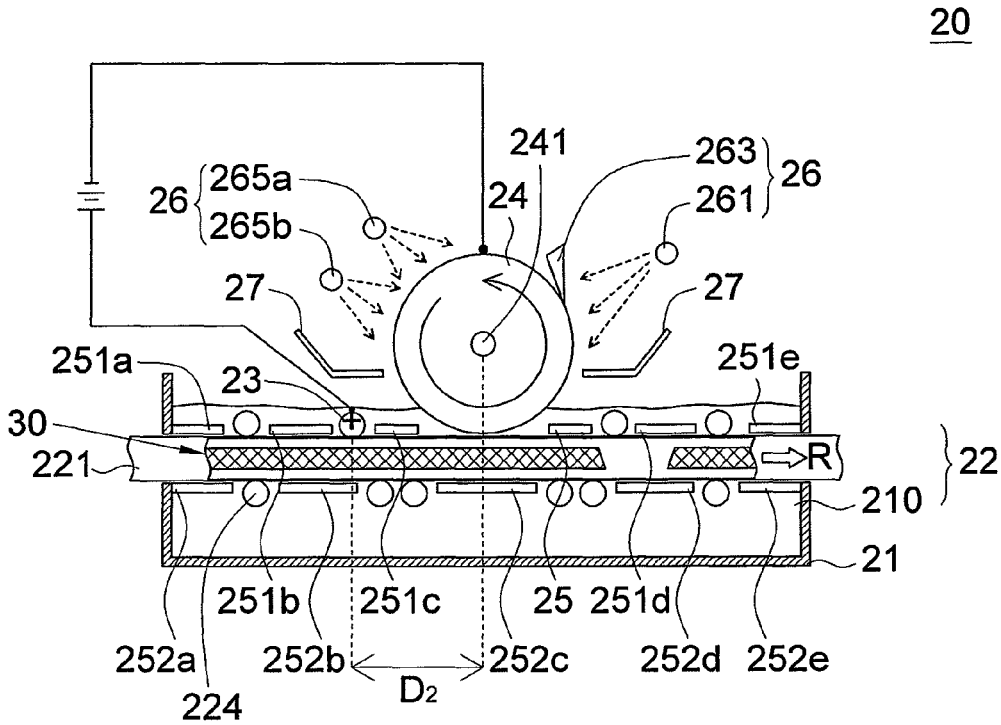
FIG. 4 shows an electro-thinning apparatus according to a first embodiment of the invention.

Referring to FIG. 4, an electro-thinning apparatus according to a first embodiment of the invention is shown. The method for removing excess metal from the surface metal layer of the substrate of the invention mainly provides at least one continuously operating electro-thinning apparatus 20 as indicated in FIG. 4. After the to-be-processed substrate is continuously conveyed in the electro-thinning apparatus 20 for conducting electrolytic reaction, excess metal is removed from the surface. Moreover, in the first embodiment, electrolytic reaction is conducted in one single electro-thinning apparatus.

According to the first embodiment of the invention, the continuously operating electro-thinning apparatus 20 being horizontally disposed mainly includes a electrolysis bath 21 containing sufficient electrolysis liquid 210, a transportation system 22, an anode roller 23, a cathode roller 24 and at least one shielding plate 25.

As indicated in FIG. 4, the transportation system 22 is disposed in the electrolysis bath (for example, the transportation system 22 is immersed in the electrolysis liquid 210) for moving a substrate 30 from an upstream end (the left end of the diagram) of the transportation system 22 to a downstream end (the right end of the diagram), and the moving direction is denoted as an arrow R. The transportation system 22 has many different types of structures, and is exemplified by a commonly seen structure of continuous conveyance in the present embodiment. For example, the transportation system 22 includes a supporting plate 221 for carrying a to-be-processed substrate 30, one set of guiding rails (not illustrated) correspondingly disposed at two sides of the supporting plate 221, and multiple sets of guiding rollers 224 being interlaced with each other. The guiding rollers 224 are correspondingly disposed under the supporting plate 221, so that the supporting plate 221 can continuously move along the guiding rails for horizontally conveying the substrate 30. The substrate 30 disposed on the supporting plate 221 is immersed in the electrolysis liquid. However, the detailed designs and elements of the transportation system 22 are not limited to the exemplification in the present embodiment, and any designs of the transportation system 22 enabling the substrate 30 to be continuously conveyed in the electro-thinning apparatus 20 and go with the following reactions can be used in the invention.

The anode roller 23 is disposed in the electrolysis bath 21 and located at the upstream end of the transportation system 22. Preferably, the anode roller 23 is disposed upstream to the cathode roller 24. The anode roller 23 can be located above the transportation system 22 and partly immersed in the electrolysis liquid 210 or is completely immersed in the electrolysis liquid 210 as is exemplified in the present embodiment. The invention does not impose any particular restrictions.

The cathode roller 24 is located above the transportation system 22 and preferably located downstream to the anode roller 23, and at least one part (such as the bottom) of the cathode roller 24 is immersed in the electrolysis liquid 210. In an embodiment of the invention, the shaft 241 of the cathode roller 24 is located above the surface of the electrolysis liquid 210, and the radius of the cathode roller 24 is larger than that of the anode roller 23.

During electrolysis, the anode roller 23 contacts the substrate 30, but a distance is kept between the cathode roller 24 and the surface metal layer of the substrate 30, that is, the cathode roller 24 is away from the substrate 30 (i.e. does not contact the substrate 30). Thus, in the electro-thinning apparatus 20, the vertical distance from the anode roller 23 to the supporting plate 221 is smaller than that from the cathode roller 24 to the supporting plate 221. In one embodiment, the distance between the cathode roller 24 and the substrate 30 could be instantly varied during electrolysis according to the practical conditions. The horizontal distance D2 between the anode roller 23 and the cathode roller 24 is determined according to actual conditions in practical applications. For example, the horizontal distance D2 can be adjusted to an optimum value, according to the voltage and total currents of the electro-thinning apparatus 20.

Figure 5:
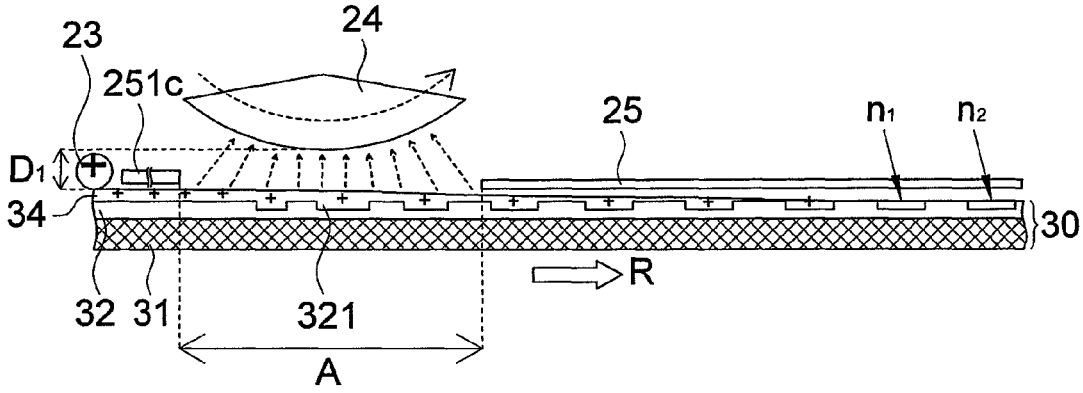
FIG. 5 shows a partial enlargement of an anode roller, a cathode roller and a substrate of FIG. 4.

Referring to FIG. 4 and FIG. 5. FIG. 5 shows a partial enlargement of an anode roller, a cathode roller and a substrate of FIG. 4. During electrolysis, the substrate 30 immersed in the electrolysis liquid 210 is conveyed by the transportation system 22 and is continuously moved from the upstream end to the downstream end, meanwhile, the anode roller 23 contacts the to-be-processed surface (containing excess metal) of the substrate 30, so that the metal on the surface metal layer of the substrate possesses anode electrical property (i.e. carrying amounts of positive charges). A distance D1 is kept between the cathode roller 24 and the to-be-processed surface metal layer of the substrate 30, wherein at least one part of the cathode roller 24 is dipped in the electrolysis liquid 210, and there is no direct contact between the cathode roller 24 and the to-be-processed surface metal layer of the substrate 30). When the surface metal layer of the substrate 30 possessing anode electrical property is moved to the position close to the underneath of the cathode roller 24, an electrical field (as indicated by a dotted arrow) generated between the surface metal layer of the substrate 30 and the cathode roller 24 conducts electrolysis for removing excess metal 34 from the surface metal layer of the substrate 30, and further depositing the excess metal on the surface of the cathode roller 24 (this process is called de-plating process). Thus, excess metal is removed from the surface metal layer of the substrate without causing any damages to the substrate.

Moreover, the substrate of the embodiment shown in FIG. 5 is exemplified by an embedded-trace substrate. During the manufacturing of an embedded-trace substrate, a trench 321 is defined on the thick resin layer 32 formed on the core 31, and the conductive metal 34 covers the thick resin layer 32 for filling the trench 321, and the metal inside the trench 321 forms a circuit pattern on the substrate. By using the embodiment of the invention in the manufacturing process, excess conductive metal 34 can be quickly removed from the surface metal layer of the substrate without damaging the substrate, so that the metal inside the trench and the surface of the resin layer 32 are co-planar as indicated in the substrate structure (excess metal has been removed from the surface metal layer of the substrate) at the right hand side of FIG. 5, and the embedded-trace substrate being formed has a planarized surface and uniformed thickness. The invention can be used in various types of substrates such as the embedded-trace substrate 30 for example. The invention can be used for removing excess metal from the surface metal layer of the substrates of various structures.

During electrolysis, the distance D1 between the cathode roller 24 and the surface metal layer of the substrate 30 is inversely proportional to the de-plating rate. That is, the smaller the distance D1, the faster the de-plating rate. Also, the larger the current density I, the faster the de-plating rate. The moving velocity V of the substrate 30 in the transportation system can be determined according to the required de-plating rate (the thickness of the excess metal to be removed) to obtain an adequate value. Thus, the values of the parameters including the distance D1, the current density I, and the moving velocity V are not limited and can be determined according to actual needs.

Moreover, after the excess metal on the surface metal layer of the substrate 30 is melted, the melted excess metal is moved towards the cathode roller 24 and deposits at the cathode. Thus, the shaft 241 of the cathode roller 24 is preferably set at position higher than the surface of the electrolysis liquid 210. If the shaft 241 of the cathode roller 24 contacts the surface of the electrolysis liquid 210, the shaft 241 may be clogged up with the reduced metal, and cause the effect on the rotation of the cathode roller 24.

The electro-thinning apparatus 20 of the invention further includes at least one shielding plate 25 for shielding the downstream end of the transportation system 22. Referring to FIG. 5, the shielding plate 25 is made from an insulating material and covers the substrate 30 which passes the underneath of the cathode roller 24 and moves towards the downstream end of the transportation system 22. As indicated in FIG. 5, the surface metal 34 of the substrate 30 possesses anode electrical property after contacting the anode roller 23. When the surface metal 34 of the substrate 30 is moved towards the downstream end of the transportation system 22 but before reaching the shielding plate 25, an electrical field is generated between the region A of the surface metal 34 of the substrate 30 and the cathode roller 24 for removing excess metal from the surface metal layer of the substrate 30 by way of electrolysis. After the substrate 30 passes through the region A and moves to the underneath of the shielding plate 25, the surface metal layer of the substrate 30, which possesses anode electrical property, being shielded by the shielding plate has slight electrolytic effect and becomes very hard to electrolyze as the surface metal layer of the substrate 30 moves farther away from the cathode roller 24. For example, in the areas n1 and n2, electrolytic reaction stops automatically. Thus, the shielding plate 25 can avoid the metal on the surface metal layer of the substrate 30 being over-etched.

As indicated in FIG. 4 of the present embodiment, the electro-thinning apparatus 20 has several shielding plates 25, 251*a*~251*e*, 252*a*~252*e*, respectively disposed above and under the supporting plate 221 and interlaced with each other between the guiding rollers 224. One of the shielding plates (that is, the shielding plate 251*c*) is preferably disposed between the anode roller 23 and the cathode roller 24. Meanwhile, the effective region of the electrical field generated between the surface metal layer of the substrate 30 and the cathode roller 24 is the region A, as indicated in FIG. 5. Moreover, as shown in FIG. 4, the shielding plates 25, 251*d*, 251*e* disposed above the substrate 30 have the shielding effect of avoiding the metal on the surface metal layer of the substrate 30 being over-etched. The invention does not impose any particular restriction regarding whether the shielding plate 252*a*~252*e* disposed under the substrate 30 and the shielding plate 25, 251*a*~251*e* disposed above the substrate are made from the same or different materials.

In the present embodiment, the electro-thinning apparatus has a rectifier electrically connected to the anode roller 23 and the cathode roller 24 respectively. Preferably, the rectifier uses a micro-processor (not illustrated) to monitor and control the electrolytic reaction so as to provide suitable current density for removing excess metal uniformly by way of electrolysis, hence avoiding the metal being over-etched. An optimum current density can be determined according to the parameters such as the contact area of the substrate, the concentration of the electrolysis liquid and the to-be-removed thickness of the metal so that a maximum electrolysis efficiency could be achieved.

Besides, in the first embodiment of the invention, the electro-thinning apparatus 20 preferably has a cleaning system 26 disposed near the cathode roller 24 for cleaning and removing the metal deposits attached on the surface of the cathode roller 24. In the present embodiment, the cleaning system 26 at least includes a first spray nozzle 261, a squeeze knife 263 and a set of second spray nozzles 265*a* and 265*b*. The first spray nozzle 261 is disposed at the side from which the cathode roller 24 leaves the electrolysis bath 21 for spraying a cleaning liquid to the surface of the cathode roller 24. The squeeze knife 263 is disposed beside the first spray nozzle 261, wherein the front end of the squeeze knife 263 can press the surface of the cathode roller 24. The second spray nozzle is disposed at the side from which the cathode roller 24 enters the electrolysis bath 21 for spraying a micro-etching solution to the surface of the cathode roller 24. As indicated in FIG. 4 (the cathode roller 24 rotates anti-clockwise), when the to-be-cleaned surface of the cathode roller 24 leaves the electrolysis liquid, the squeeze knife 263, first of all, scraps the metal deposits off the surface of the cathode roller 24, while the cathode roller 24 is rotating. After the surface of the cathode roller 24 is then sprayed by the micro-etching solution from the second spray nozzles 265*a* and 265*b* for etching and cleaning the debris remained on the surface. Then, the cleaned surface of the cathode roller 24 enters the electrolysis bath 21 again and is immersed in the electrolysis liquid 210. The cleaning liquid sprayed from the first spray nozzle 261 is de-ionized water for example, and the micro-etching solution sprayed from the second spray nozzle 265*a* and 265*b* is a mixed liquid containing dilute sulfuric acid (dilute sulfuric acid) and hydrogen peroxide. According to the conventional apparatus for removing excess metal from the surface of substrate and removing method using the same, the electrolytic process has to stop so that the apparatus can be cleaned and maintained after a period of operation. However, the cleaning system 26 of the invention continuously removes the metal deposit from the surface of the cathode roller 24 when excess metal is continuously removed from the surface metal layer of the substrate 30, hence saving manufacturing time and cost.

Preferably, the electro-thinning apparatus 20 further includes a recycling system, such as a receiver 27, disposed near the cleaning system 26 for collecting metal deposits (such as copper debris) scrapped from the surface of the cathode roller 24 and for processing or recycling the collected to avoid pollution and reduce waste of materials.

Second Embodiment

Figure 6:
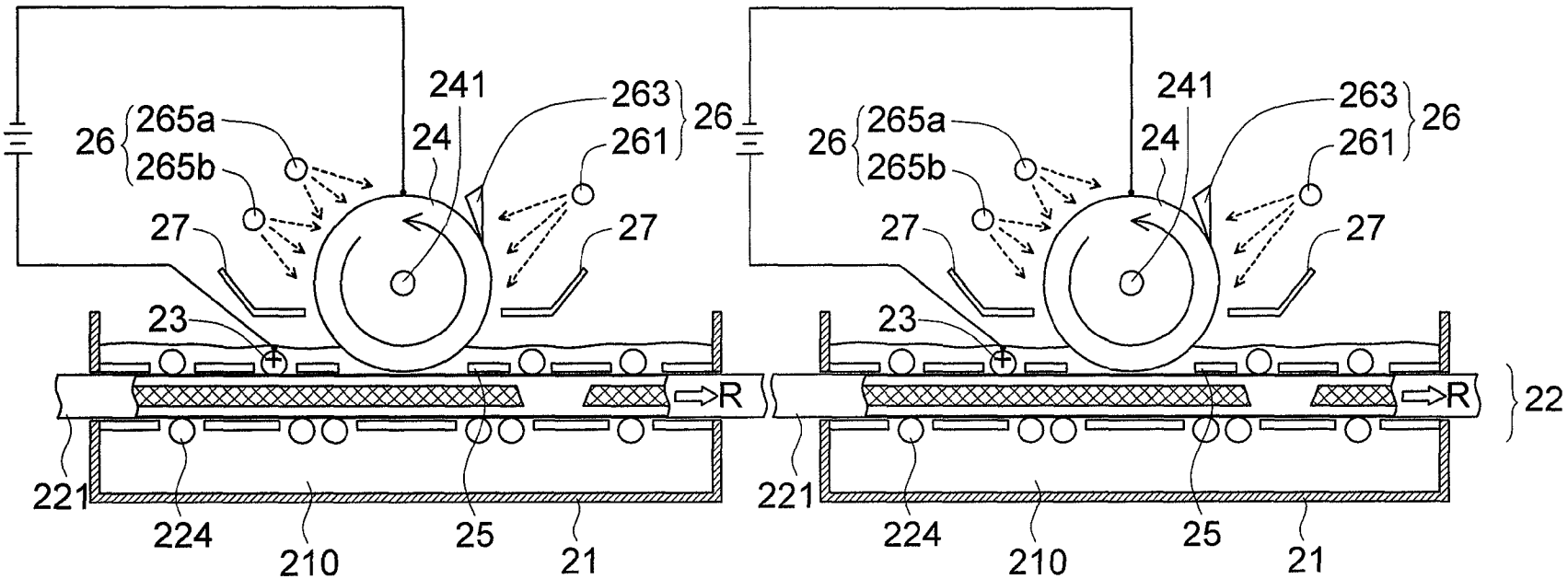
FIG. 6 shows an electro-thinning apparatus according to a second embodiment of the invention, wherein the electrochemical equipment includes two electro-thinning apparatuses.

According to the present embodiment of the invention, more than one electro-thinning apparatus of the first embodiment can be used for removing excess metal from the surface metal layer of the substrate. FIG. 6 shows an electro-thinning apparatus according to a second embodiment of the invention, wherein the electrochemical equipment includes two electro-thinning apparatuses. The structure and elements of each electro-thinning apparatus are disclosed in the first embodiment, and are not repeated here again.

The second embodiment mainly provides at least two continuously operating electro-thinning apparatuses 20, so that the to-be-processed substrate is continuously conveyed electrolyzed in the first electro-thinning apparatus first and in the second electro-thinning apparatus subsequently for removing excess metal from the surface of the to-be-processed substrate. The two continuously operating electro-thinning apparatuses are operated independently and each has a rectifier for independently controlling respective electro-thinning apparatus. Moreover, according to actual needs, the two electro-thinning apparatus can have the same or different electrolysis rates in removing excess metal from the surface metal layer of the substrate. For example, the two continuously operating electro-thinning apparatuses have different concentrations of electrolysis liquid or relevant electrolytic parameters so that the two electro-thinning apparatuses have different electrolysis rates. However, as long as the excess metal can be completely removed, the invention does not impose any restrictions regarding the electrolysis rates and other parameters of the electro-thinning apparatuses of the electrochemical equipment.

The electrolysis liquid used in the first and the second embodiment of the invention may include metal ions, sulfuric acid, phosphate, a pH buffer and an organic leveler. When the surface metal layer of the substrate has excess copper to be removed, the electrolysis liquid includes copper ions. Phosphate protects the conductive pattern of the product from being etched due to over-de-plating. The organic leveler improves the distribution of electrical field on the surface of the metal by way of organic materials, so that the de-plating reaction between the cathode roller and the anode metal surface becomes more uniformed. In practical application, the constituents of the electrolysis liquid are not limited to those compounds exemplified in the invention, and can be further adjusted according to actual needs. Moreover, the constituents of the electrolysis liquid can be supplemented and the proportions of the constituents can be adjusted according to the state of electrolytic reaction.

Compared with the conventional method of removing excess metal from the surface metal layer of the substrate, the electro-thinning apparatus and the method disclosed in the above embodiments of the invention have many advantages exemplified below:

(1) The invention adopts non-contact electrolysis, that is, a distance (fixed or varied during electrolysis) is kept between the cathode roller and the surface metal layer of the substrate, hence avoiding the problems of deformation and non-uniformity in the substrate which occur to the conventional mechanical grinding process which directly applies a stress to the substrate. Thus, after excess metal is removed from the substrate, the substrate using the method of the invention still remains good external appearance and electrical properties, and the yield rates of the elements are not affected.

(2) According to the invention, the non-contact electrolytic reaction occurs above the substrate, and the transportation system is disposed under the substrate. By using the transportation system disclosed in the embodiments of the invention, a thinner substrate can be conveyed in the electro-thinning apparatus for removing excess metal, and there is no risk that the thin substrate might be deformed or broken.

(3) A distance (fixed or varied during electrolysis, non-contact electrolysis) is kept between the cathode roller and the surface metal layer of the substrate. Therefore, a current density provided to the electro-thinning apparatus can be fixed at a certain value.

(4) The invention provides a horizontal and continual electro-thinning apparatus which is used in substrates of various sizes, and the parameters of the transportation system of the electro-thinning apparatus (such as the speed of conveying the substrate) can be adjusted according to the to-be-removed thickness of the metal.

(5) The electro-thinning apparatus is equipped with a rectifier which uses a micro-processor to monitor and control the electrolytic reaction so that suitable volume of current density is provided for uniformly removing excess metal without over-removing excess metal. An optimum current density can be obtained according to parameters, such as the contact area of the substrate, the concentration of the electrolysis liquid and so on, to achieve a maximum electrolysis efficiency.

(6) The shielding plate of the electro-thinning apparatus avoids the metal on the surface metal layer of the substrate being over-etched, and as the surface metal layer of the substrate moves farther away from the cathode roller, electrolysis becomes more and more difficult, and electrolytic reaction automatically stops. Thus, the etching stop point can be controlled.

(7) The electro-thinning apparatus preferably is equipped with a cleaning system for keeping the surface of the cathode roller clean and free of metal deposit, so that the electro-thinning apparatus can remove excess metal continuously without having to stop to be cleaned. The electro-thinning apparatus of the invention saves manufacturing time and cost, and is free of the conventional problem that the substrate might be scratched, cracked or damaged by metal residue.

(8) The electro-thinning apparatus could be preferably equipped with a recycling system for recycling materials.

(9) The cleaning system and the recycling system could be preferably disposed above the electrolysis bath for recycling metal residue, so that pollution is avoided and the electrolysis liquid can be used repeatedly.

(10) In the electro-thinning apparatus, preferably, the shaft of the cathode roller is positioned higher than the surface of e electrolysis liquid, lest the reduced metal may crystallize on the shaft and obstruct the movement of the shaft, and affect the rolling of the cathode roller.

While the invention has been described by way of example and in terms of the embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electro-thinning apparatus for removing excess metal from a surface metal layer of a substrate, comprising:

an electrolysis bath containing an electrolysis liquid;

a transportation system disposed in the electrolysis bath for moving a substrate from an upstream end to a downstream end of the transportation system, wherein the surface metal layer of the substrate is immersed in the electrolysis liquid;

an anode roller disposed relative to the electrolysis bath and located at the upstream end of the transportation system, wherein the anode roller is configured to be in contact with the surface metal layer of the substrate during electrolysis;

a cathode roller located downstream to the anode roller, wherein the cathode roller is partly immersed in the electrolysis liquid but away from the surface metal layer of the substrate during electrolysis; and at least one shielding plate located downstream to the cathode roller;

wherein, when the surface metal layer of the substrate contacts the anode roller and the substrate is moved towards the downstream end of the transportation system, there is an electrical field between the cathode roller and the surface metal layer of the substrate except for the area of the substrate being shielded by the shielding plate.

2. The electro-thinning apparatus according to claim 1, wherein the transportation system comprises:

a supporting plate used for carrying the substrate;

one set of guiding rails correspondingly disposed at two sides of the supporting plate; and a plurality of guiding rollers correspondingly disposed under the supporting plate so that the supporting plate is continuously moved along the set of guiding rails for horizontally conveying the substrate.

3. The electro-thinning apparatus according to claim 2, comprises a plurality of shielding plates respectively disposed above and under the supporting plate, and the shielding plates are interlaced with each other between the guiding rollers.

4. The electro-thinning apparatus according to claim 3, wherein one of the shielding plates is located between the anode roller and the cathode roller.

5. The electro-thinning apparatus according to claim 2, wherein a vertical distance from the anode roller to the supporting plate is smaller than that from the cathode roller to the supporting plate.

6. The electro-thinning apparatus according to claim 1, wherein the radius of the cathode roller is larger than that of the anode roller.

7. The electro-thinning apparatus according to claim 1, wherein the shaft of the cathode roller is higher than the surface of the electrolysis liquid.

8. The electro-thinning apparatus according to claim 1, wherein the electro-thinning apparatus further comprises a cleaning system disposed near the cathode roller for cleaning the surface of the cathode roller.

9. The electro-thinning apparatus according to claim 8, wherein the cleaning system comprises:

a first spray nozzle disposed at the side from which the cathode roller leaves the electrolysis bath for spraying a cleaning liquid to the surface of the cathode roller;

a squeeze knife disposed besides the first spray nozzle, wherein the front end of the squeeze knife presses the surface of the cathode roller for scraping metal deposits off the cathode roller surface; and a second spray nozzle disposed at the side from which the cathode roller enters the electrolysis bath for spraying a micro-etching solution to the surface of the cathode roller.

10. The electro-thinning apparatus according to claim 9, further comprising a recycling system disposed near the cleaning system for collecting the metal deposits scrapped from the surface of the cathode roller.

11. The electro-thinning apparatus according to claim 9, wherein the cleaning liquid is de-ionized water, and the micro-etching solution is a mixed liquid containing dilute sulfuric acid and hydrogen peroxide.

12. The electro-thinning apparatus according to claim 1, wherein the electrolysis liquid comprises metal ion, sulfuric acid, phosphate, pH buffer and organic leveler.

13. The electro-thinning apparatus according to claim 1, wherein when the surface metal layer of the substrate has excess copper to be removed, the electrolysis liquid contained in the electrolysis bath comprises copper ions.

14. The electro-thinning apparatus according to claim 1, further comprising a rectifier electrically connected to the anode roller and the cathode roller for monitoring and adjusting the electrolytic reaction of removing excess metal.

15. A method for removing excess metal from a surface metal layer of a substrate, comprises the steps of:

providing an electro-thinning apparatus, comprising:

an electrolysis bath containing an electrolysis liquid;

a transportation system disposed in the electrolysis bath and having an upstream end and a downstream end;

an anode roller located at the upstream end of the transportation system;

a cathode roller located downstream to the anode roller, wherein the cathode roller is partly immersed in the electrolysis liquid; and at least one shielding plate located downstream to the cathode roller;

disposing a substrate in the transportation system;

moving the substrate from the upstream end to the downstream end of the transportation system wherein the surface metal layer of the substrate is kept immersed in the electrolysis liquid but away from the cathode roller; and electrolyzing the excess metal by contacting the anode roller with the surface metal layer such that an electrical field is generated between the cathode roller and the surface metal layer of the substrate except for the area of the substrate being shielded by the shielding plate.

16. The method according to claim 15, further comprising:

cleaning the surface of the cathode roller which is away from the electrolysis liquid during the electrolyzing step.

17. The method according to claim 16, further comprising:

removing metal deposits formed on the cathode roller and cleaning the surface of the cathode roller by a micro-etching solution during the electrolyzing step.

18. The method according to claim 15, further comprising using a rectifier electrically connected to the anode roller and the cathode roller to monitor and adjust the electrolytic reaction during the electrolyzing step.

* * * * *